US010618306B2

(12) United States Patent
Nabeshima

(10) Patent No.: US 10,618,306 B2
(45) Date of Patent: Apr. 14, 2020

(54) LIQUID DISCHARGE APPARATUS AND LIQUID DISCHARGE HEAD

(71) Applicant: CANON KABUSHIKI KAISHA, Tokyo (JP)

(72) Inventor: Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 15/882,641

(22) Filed: Jan. 29, 2018

(65) Prior Publication Data

US 2018/0215168 A1 Aug. 2, 2018

(30) Foreign Application Priority Data

Jan. 31, 2017 (JP) ..... 2017-015515

(51) Int. Cl.
*B41J 2/18* (2006.01)
*B41J 2/175* (2006.01)
*B41J 2/14* (2006.01)

(52) U.S. Cl.
CPC ..... *B41J 2/18* (2013.01); *B41J 2/14032* (2013.01); *B41J 2/14201* (2013.01); *B41J 2/175* (2013.01); *B41J 2/17596* (2013.01)

(58) Field of Classification Search
CPC ..... B41J 2/17596; B41J 2/14201; B41J 2/14032; B41J 2/175
See application file for complete search history.

(56) References Cited

U.S. PATENT DOCUMENTS 9,327,514 B2 * 5/2016 Nishiyama ..... B41J 2/17596
2009/0009569 A1 1/2009 Sasaki
2009/0284563 A1 * 11/2009 Bansyo ..... B41J 2/16532 347/19
2010/0177148 A1 * 7/2010 Asami ..... B41J 2/175 347/85
2010/0208010 A1 * 8/2010 Inoue ..... B41J 2/19 347/85
2010/0214334 A1 * 8/2010 Kusunoki ..... B41J 2/04581 347/9
2011/0199440 A1 8/2011 Kobashi
2012/0024395 A1 2/2012 Furukawa et al.
2012/0160925 A1 6/2012 Hoisington
2014/0118448 A1 * 5/2014 Domae ..... B41J 2/18 347/89

FOREIGN PATENT DOCUMENTS

EP 2050572 A2 4/2009
JP H0679876 A 3/1994
JP 3090698 B2 9/2000
JP 2006068904 A 3/2006
JP 5029395 B2 9/2012
JP 2013144461 A 7/2013

* cited by examiner

*Primary Examiner* — Henok D Legesse

(74) *Attorney, Agent, or Firm* — Canon U.S.A., Inc. IP Division

(57) ABSTRACT

A common supply channel is connected to one end of a discharge module having a discharge orifice that discharges liquid, and a common recovery channel is connected to the other end of the discharge module. A valve connecting the common supply channel and common recovery channel is provided in an adjustment channel, and is opened under a first opening pressure. A pump causes liquid to flow from the common supply channel toward the common recovery channel. Flow resistance of the common recovery channel is smaller than flow resistance of the discharge module.

19 Claims, 9 Drawing Sheets

LIQUID DISCHARGE APPARATUS AND LIQUID DISCHARGE HEAD

BACKGROUND OF THE INVENTION

Field of the Invention

The present invention relates to a liquid discharge apparatus and a liquid discharge head that discharge liquid.

Description of the Related Art

High-speed and stable discharge of a high-viscosity liquid of which the viscosity is high may be demanded of liquid discharge apparatuses. For example, in recent years, there is demand for ink jet recording apparatuses, which are a type of liquid discharge apparatuses, to discharge high-viscosity liquid at high speeds and in a stable manner. High-viscosity liquid is used to suppress permeation of the liquid into the recording medium, so as to record on recording media such as plain paper with high quality at high speeds.

Channels resistance of channels through which the liquid flows increases when using high-viscosity liquid. Accordingly, the amount of supplied liquid may be insufficient, and as a result, defective discharge may occur. One conceivable way to suppress such defective discharge is to increase the cross-sectional area of the channel, thereby reducing the channel resistance, but this method also leads to increased size of the apparatus.

As opposed to this, Japanese Patent No. 5,029,395 discloses a liquid discharge apparatus capable of suppressing defective discharge while suppressing increase in size. This liquid discharge apparatus includes a supplying common channel that supplies liquid, a discharge unit that discharges liquid, a circulatory common channel that recovers liquid, and assisting means that circulate the liquid in the order of the supplying common channel, discharge unit, and circulatory common channel. This liquid discharge apparatus forcibly circulates liquid using the assisting means, so liquid supply capability to the discharge unit is improved. Accordingly, insufficient supply of liquid can be suppressed, and as a result, defective discharge can be suppressed.

However, the liquid discharge apparatus described in Japanese Patent No. 5,029,395 supplies liquid to be discharged and liquid to generate backpressure together to the discharge unit, increasing the flow rate of liquid flowing through the discharge unit. The channel resistance of the discharge unit is relatively high due to structural constraints, so the greater the flow rate of the liquid flowing through the discharge unit is, the greater the pressure loss is. Accordingly, increasing the flow rate for even higher speed discharge increases the backpressure at the discharge unit, and the backpressure may exceed the appropriate range of backpressure for the discharge unit. This leads to disorder of droplets being discharged, and defective discharge occurs as a result.

SUMMARY OF THE INVENTION

It has been found desirable to provide a liquid discharge apparatus and a liquid discharge head whereby defective discharge can be suppressed even in cases of performing discharge at further higher speeds.

A first liquid discharge apparatus according to the present invention includes: a plurality of discharge portions that include a discharge orifice configured to discharge liquid; a common supply channel for liquid, connected to one end side of the plurality of discharge portions; a common recovery channel for liquid, connected to the other end side of the plurality of discharge portions; an adjustment channel connecting the common supply channel and the common recovery channel; a first valve that is provided in the adjustment channel and is opened under a first opening pressure; and a first fluid arrangement configured to cause the liquid to flow from the common supply channel toward the common recovery channel. Channel resistance of the adjustment channel is smaller than channel resistance of the discharge portion.

A liquid discharge head according to the present invention includes: a plurality of pressure chambers, each having within an energy-generating element configured to generate energy used to discharge liquid from a discharge orifice; a common supply channel configured to supply liquid to the pressure chambers, connected to one end side of the plurality of pressure chambers; a common recovery channel configured to recover liquid from the pressure chambers, connected to the other end side of the plurality of pressure chambers; an adjustment channel connecting the common supply channel and the common recovery channel; and a valve that is provided in the adjustment channel and is opened under a predetermined opening pressure. Channel resistance of the adjustment channel is smaller than channel resistance of channels including the pressure chambers and connecting the common supply channel and the common recovery channel.

A second liquid discharge apparatus according to the present invention includes: a plurality of pressure chambers, each having within an energy-generating element configured to generate energy used to discharge liquid from a discharge orifice; a common supply channel connected to one end side of the plurality of pressure chambers; a common recovery channel connected to the other end side of the plurality of pressure chambers; an adjustment channel connecting the common supply channel and the common recovery channel; a valve that is provided in the adjustment channel and is opened under a predetermined opening pressure; and a fluid arrangement configured to cause the liquid to flow from the common supply channel toward the common recovery channel. The liquid discharge apparatus operates in a first flow mode, where liquid is caused to flow from the common supply channel to the common recovery channel via the pressure chambers, without liquid being discharged from the discharge orifice, and a second flow mode, where liquid is caused to flow from the common supply channel to the common recovery channel via the pressure chambers, while liquid is discharged from the discharge orifice. The valve is closed in the first flow mode and is open in the second flow mode.

Further features of the present invention will become apparent from the following description of exemplary embodiments with reference to the attached drawings.

DESCRIPTION OF THE EMBODIMENTS

Figure 1:
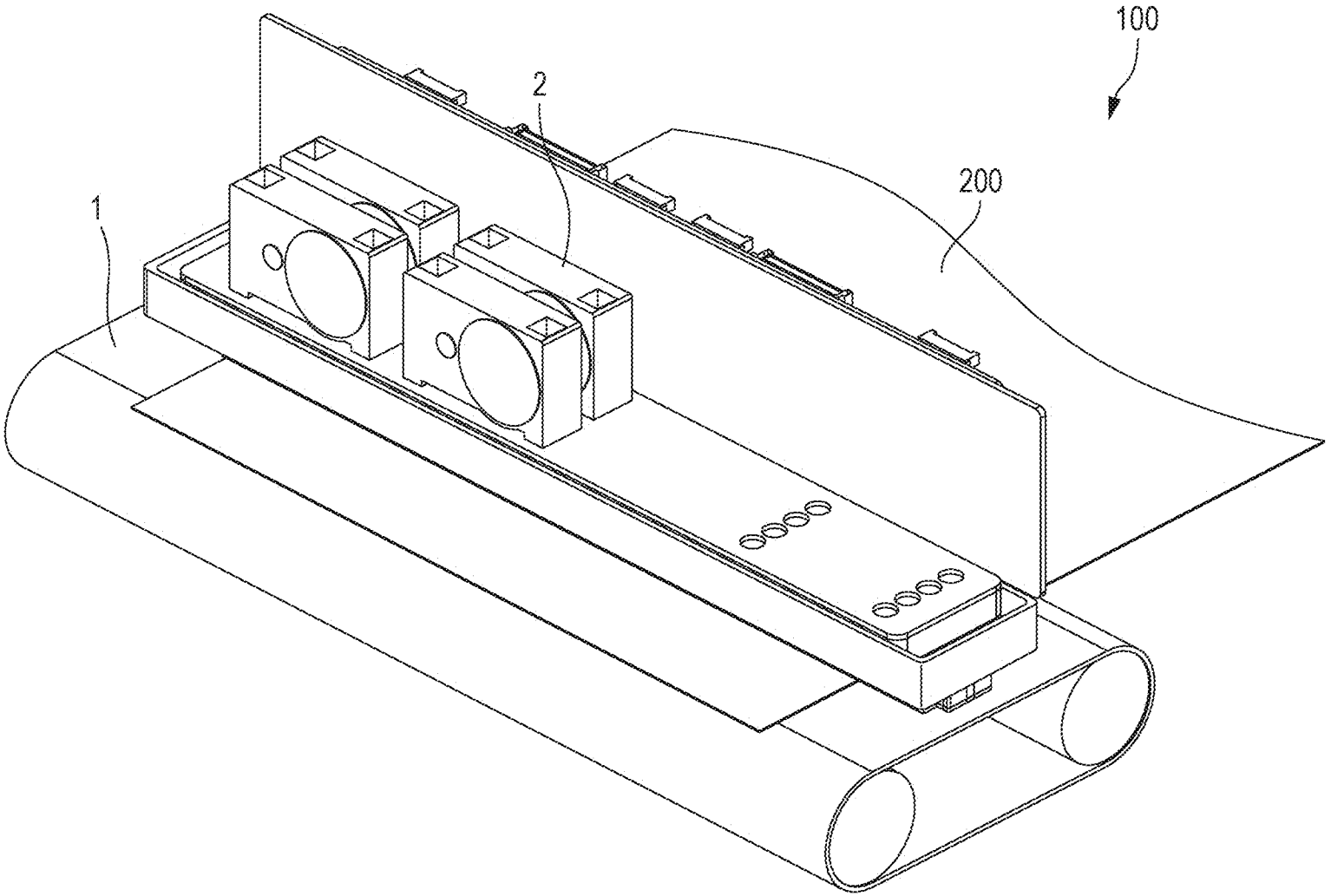
FIG. 1 is a perspective view schematically illustrating a liquid discharge apparatus according to a first embodiment of the present invention.

Embodiments of the present invention will be described with reference to the drawings. Note that components in the drawings that have the same functions may be denoted by the same reference numerals, and repetitive description thereof may be omitted.

First Embodiment

FIG. 1 is a perspective view schematically illustrating a liquid discharge apparatus according to a first embodiment of the present invention. The liquid discharge apparatus 100 illustrated in FIG. 1 is an ink jet recording apparatus that discharges ink that is a liquid onto a recording medium 200 such as paper or the like, thereby recording on the recording medium 200. The recording medium 200 may be cut sheets cut to standard dimensions, or may be a roll sheet that is long in shape.

The liquid discharge apparatus 100 includes a conveying unit 1 that conveys the recording medium 200, and a liquid discharge head 2 that discharges liquid as to the recording medium 200 conveyed by the conveying unit 1 and records onto the recording medium 200. The liquid discharge head 2 is a line-type (pagewide type) liquid discharge head that has a length corresponding to the width of the recording medium 200, and is disposed generally orthogonal to the conveyance direction of the recording medium 200. The liquid discharge apparatus 100 is a line recorder that performs single-pass continuous recording on the recording medium 200 using the liquid discharge head 2, while continuously or intermittently conveying the recording medium 200 using the conveying unit 1.

Regarding the liquid, the liquid discharge head 2 is capable of discharging multiple types of liquid (e.g., cyan, magenta, yellow, and black ink). The liquid discharge head 2 is connected by fluid connection to a tank (omitted from illustration) that stores liquid, via a channel (omitted from illustration) that supplies liquid to the liquid discharge head 2. The tank may be divided into a main tank, buffer tank, or the like. The liquid discharge head 2 is also electrically connected to a control unit (omitted from illustration) that transmits logic signals to drive and control the liquid discharge head 2.

Note that the liquid discharge head 2 is not restricted to a line-type liquid discharge head, and may be a serial-type liquid discharge head that records while scanning the recording medium 200. The liquid discharge method by which the liquid discharge head 2 discharges liquid is not restricted in particular. Examples of liquid discharge methods include the thermal method where liquid is discharged by generating bubbles using a heater, the piezoelectric method using a piezoelectric device, and various other liquid discharge methods.

Figure 2A:
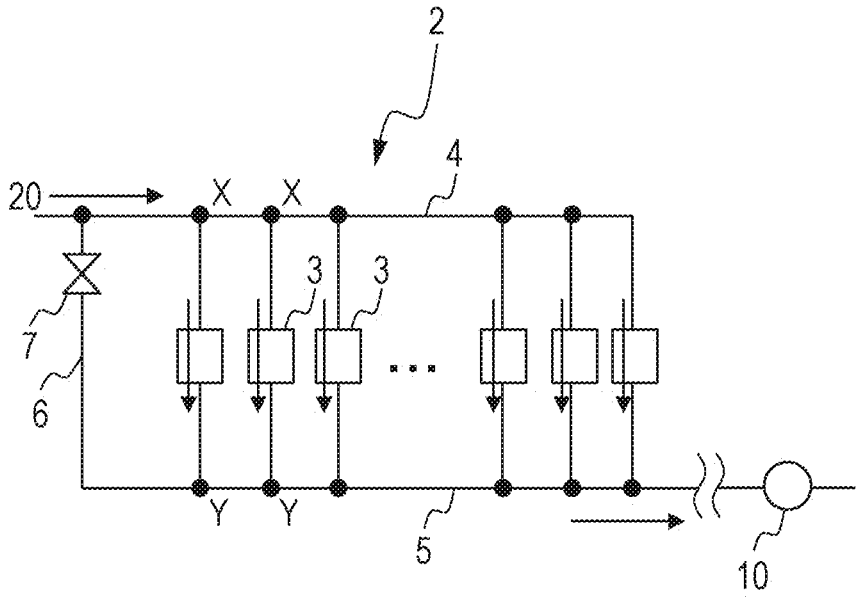
FIGS. 2A and 2B are channel diagrams illustrating the channel configuration of the liquid discharge apparatus according to the first embodiment of the present invention.
Figure 2B:
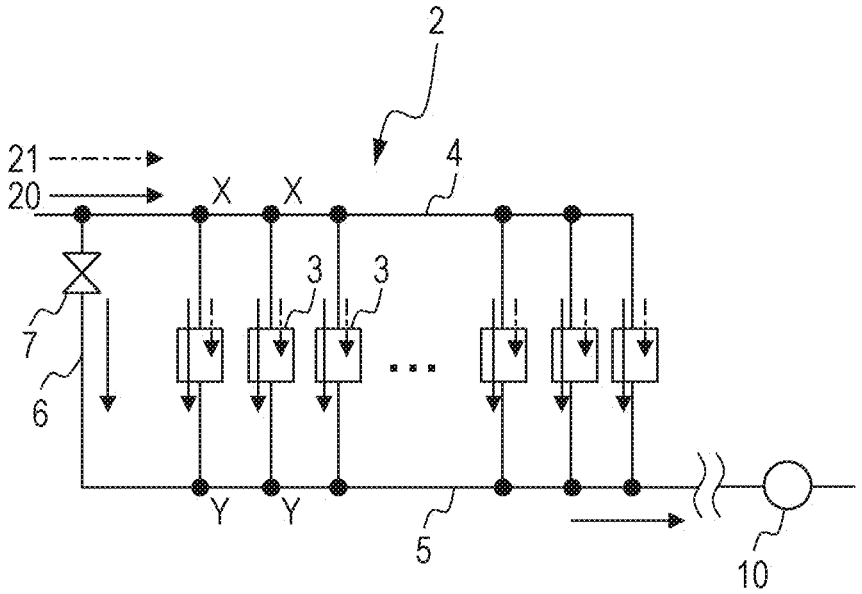

FIGS. 2A and 2B are channel diagrams schematically illustrating the configuration of channels of the liquid discharge head 2 through which liquid flows. FIG. 2A illustrates the liquid discharge head 2 in a first state where liquid is flowing but discharge is not being performed, and FIG. 2B illustrates the liquid discharge head 2 in a second state where liquid is flowing and discharge is being performed.

The liquid discharge head 2 includes discharge modules 3 that are discharge portions having discharge orifices 13 that discharge liquid (see FIG. 11), a common supply channel 4 that is a supply channel to supply liquid, and a common recovery channel 5 that is a recovery channel to recover liquid, as illustrated in FIGS. 2A and 2B. It is sufficient to have at least one discharge module 3, but the example in FIGS. 2A and 2B has multiple discharge modules 3, which are connected in parallel. It is sufficient for each discharge module 3 to have at least one discharge orifice 13, but multiple discharge orifices 13 are provided to each discharge module 3 in the present embodiment. The liquid is supplied to the discharge modules 3 (pressure chambers 23) via individual channels branching from X portions of the common supply channel 4, and is recovered to the common recovery channel 5 via individual channels. The individual channels and the common recovery channel 5 are connected at Y portions in FIGS. 2A and 2B.

Further, the liquid discharge head 2 has an adjustment channel 6 that connects the common supply channel 4 and common recovery channel 5 to each other without going through the discharge modules 3. Specifically, the adjustment channel 6 connects the common supply channel 4 at the upstream side from all X portions where the common supply channel 4 is connected to the discharge modules 3, and the common recovery channel 5 at the upstream side from all Y portions where the common recovery channel 5 is connected to the discharge modules 3. The channel resistance of the adjustment channel 6 is smaller than the channel resistance of the discharge module 3. More specifically, the channel resistance of the entire adjustment channel 6 is smaller than the flow resistance of the entire channels that include pressure chambers 23 and connect the common supply channel 4 and common recovery channel 5 (channels connecting the Xs and Ys in FIGS. 2A and 2B. Accordingly, the channel resistance of the adjustment channel 6 is smaller than the channel resistance of the channels that the liquid passes through when flowing through the discharge modules 3. The adjustment channel 6 is provided with a valve 7, which is a first valve, that opens under a first opening pressure. The first opening pressure is defined by differential pressure between the upstream side and downstream side of the valve 7. The valve 7 specifically is opened when the differential pressure at the common supply channel 4 side and common recovery channel 5 side of the valve 7 is the first opening pressure or greater. The first opening pressure is set beforehand to match a pressure (differential pressure) applied to the valve 7 when the flow rate of the liquid is a predetermined amount.

The liquid discharge apparatus 100 has a pump 10 serving as a first flowage unit that causes liquid to flow in the order of common supply channel 4, discharge module 3, and common recovery channel 5. The installation position and so forth of the pump 10 is not restricted in particular, but in the present embodiment, the pump 10 is provided outside of the liquid discharge head 2, and specifically downstream of the common recovery channel 5.

The liquid discharge apparatus 100 in the present embodiment recovers liquid from the common recovery channel 5 and returns the liquid to a storage tank to be supplied to the common supply channel 4, thereby circulating the liquid between the tank and the liquid discharge head 2. However, a configuration may be made where separate tanks are provided at each of the upstream side and downstream side of the liquid discharge head 2, with liquid being supplied from one tank to the common supply channel 4, and the liquid flowing from the common recovery channel 5 to the other tank.

FIG. 2A illustrates a first state (first flow mode) where liquid is flowing, but discharge is not being performed, as described above. At this time, the substantive flow of liquid through channels in the liquid discharge head 2 is only a circulatory flow 20 indicated by solid arrows. The circulatory flow 20 is a flow of liquid supplied from the common supply channel 4 and recovered at the common recovery channel 5 without being discharged. The circulatory flow 20 flows in the order of common supply channel 4, discharge module 3, and common recovery channel 5 in the example in FIG. 2A. The circulatory flow 20 is controlled by the pump 10 so as to be a constant flow.

In the first state, when the pump 10 causes the circulatory flow 20 to flow, pressure loss occurs due to the channel resistance of the common supply channel 4 and discharge modules 3, so the pressure within the common recovery channel 5 is lower than the pressure within the common supply channel 4. Accordingly, a certain amount of pressure (differential pressure) is applied to the valve 7. However, the opening pressure (first opening pressure) of the valve 7 is set so as to be greater than the pressure applied to the valve 7 in the first state, so that the valve 7 does not open under the first state.

On the other hand, FIG. 2B illustrates the liquid discharge head 2 in a second state (second flow mode) where liquid is flowing and also discharge from the discharge orifices is being performed, as described above. At this time, discharge flows 21, indicated by dotted line arrows, are generated within the channels of the liquid discharge head 2, in addition to the circulatory flow 20. The discharge flows 21 flow in the order of the common supply channel 4 and discharge modules 3, and end at the discharge modules 3, being discharged from the discharge orifices.

In the second state, the discharge flow 21 flows in addition to the circulatory flow 20, so the flow rate of the liquid increases, and as a result the pressure loss is greater than in the first state. Accordingly, the greater the discharge flow 21 is, the lower the pressure at the common recovery channel 5 is as compared to the pressure of the common supply channel 4. The opening pressure of the valve 7 is set to match a pressure (differential pressure) applied to the valve 7 when the discharge flow 21 reaches a certain level or greater, and the flow rate of the circulatory flow 20 and discharge flow 21 combined reaches a predetermined amount.

Then the valve 7 is opened, the channel resistance of the adjustment channel 6 is smaller than the channel resistance of the discharge modules 3, so the liquid flows to the adjustment channel 6 with higher priority than the discharge modules 3. As a result, part of the circulatory flow 20 that had been flowing in the order of common supply channel 4, discharge modules 3, and common recovery channel 5, is allocated to the adjustment channel 6. Accordingly, the flow rate flowing through the discharge modules 3 where the channel resistance is high can be reduced.

Figure 3:
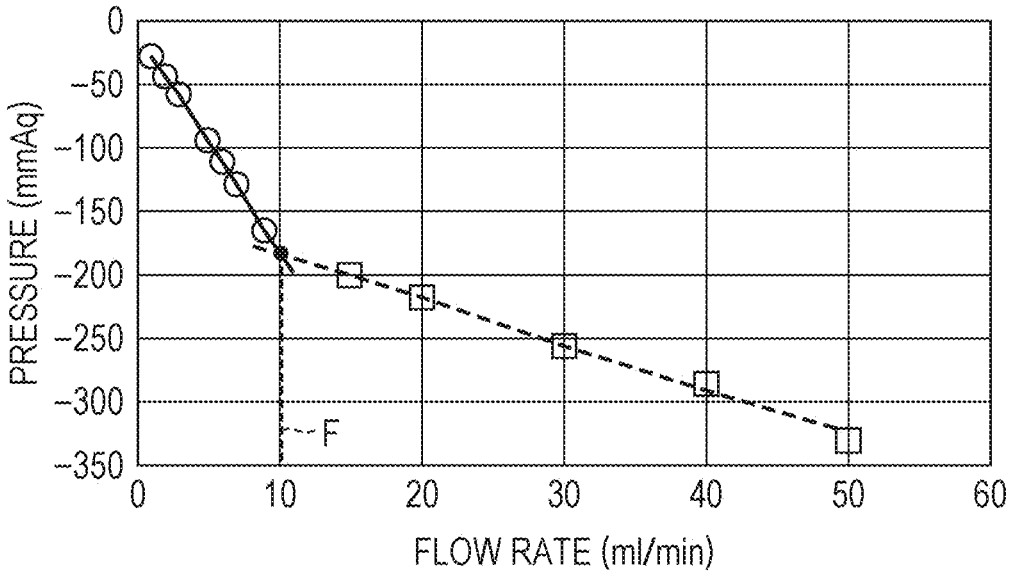
FIG. 3 is a diagram illustrating the relationship between the flow rate of liquid flowing through a channel, and pressure within the channel.

FIG. 3 is a channel diagram illustrating the relationship between the flow rate of liquid flowing through the liquid discharge head 2 and the pressure at the common recovery channel 5. The horizontal axis in FIG. 3 is the flow rate (ml/min), and the vertical axis is pressure (mmAq). Pressure is indicated by gauge pressure (backpressure), where 1 mmAq=9.80665 Pa. The pressure of the common recovery channel 5 corresponds to the backpressure of the discharge modules 3.

The flow rate when the range (inclination) of change of pressure as to the flow rate of the liquid is great, is a predetermined amount F where the valve 7 is opened, as illustrated in FIG. 3. In a state where the flow rate is smaller than the predetermined amount F and the valve 7 is not opened, all liquid flows into the discharge modules 3 where the channel resistance is great, so the pressure drop (increase in backpressure) as to the flow rate is great. On the other hand, after the valve 7 has opened, liquid also flows to the adjustment channel 6 where the channel resistance is small, so the flow rate flowing through the discharge modules 3 where the channel resistance is high decreases, and accordingly the flow in pressure as to the flow rate becomes gentle. Thus, the increase in backpressure on the discharge modules 3 can be made to be gentle by opening the valve 7. Accordingly, defective discharge can be suppressed even when performing further high-speed discharge.

Also, the adjustment channel 6 connects the upstream side of the common supply channel 4 and the upstream side of the common recovery channel 5 in the present embodiment, so there is no need for liquid lowing through the adjustment channel 6 to flow through the common supply channel 4, and the pressure loss can be further reduced. Accordingly, the increase in backpressure on the discharge modules 3 can be made to be gentler, and defective discharge can be further suppressed.

Further, a liquid flow can be generated at discharge modules 3 that are not discharging liquid while the liquid discharge head 2 is recording in the present embodiment, so thickening of liquid within the discharge modules 3 can be suppressed. Further, thickened liquid and foreign matter in the liquid can be discharged to the common recovery channel 5. This enables defective discharge to be further suppressed.

Note that the configuration illustrated in FIGS. 1 through 2B is only exemplary, and that this configuration is not restrictive. For example, the adjustment channel 6 and valve 7 is illustrated as being disposed within the liquid discharge head 2 in the example in FIGS. 2A and 2B, but may be provided outside of the liquid discharge head 2.

Second Embodiment

Figure 4:
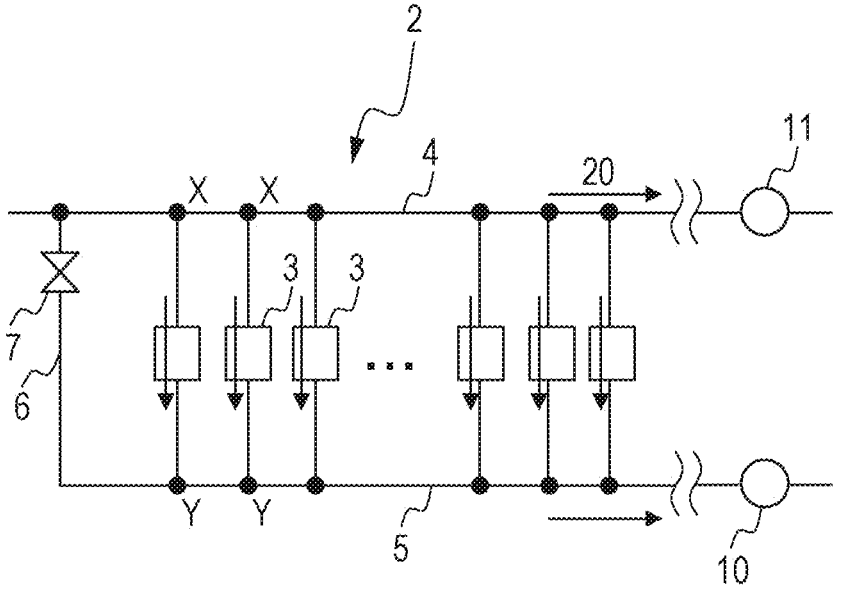
FIG. 4 is a channel diagram illustrating the channel configuration of the liquid discharge apparatus according to a second embodiment of the present invention.

FIG. 4 is a channel diagram schematically illustrating the configuration of channels of the liquid discharge head 2 through which liquid flows, according to a second embodiment of the present invention. FIG. 4 shows the liquid discharge head 2 in the first state where liquid is flowing but discharge is not being performed.

The liquid discharge head 2 according to the present embodiment as illustrated in FIG. 4 has, in addition to the configuration of the first embodiment illustrated in FIGS. 2A and 2B, a pump 11 serving as a second flowage unit. The pump 11 is provided on the downstream side of the common supply channel 4 from all X portions where the discharge modules 3 are connected, so as to cause liquid to flow through only the common supply channel 4 out of the channels of the liquid discharge head 2 (i.e., the discharge modules 3, common supply channel 4, common recovery channel 5, and adjustment channel 6).

When the amount of liquid being discharged increases, the temperature of the liquid discharge head 2 rises due to the effects of energy generated to discharge the liquid, and as a result, the temperature of the liquid flowing through the liquid discharge head 2 also rises. When the temperature of the liquid rises, the physical properties of the liquid also change accordingly, which may affect discharging and lead to poor image quality of the image that is recorded. Deterioration in image quality is particularly marked in cases where the temperature difference of liquid supplied to mutually adjacent discharge modules 3 is great.

The temperature of the liquid at the downstream side of the common supply channel 4 is higher as compared to the liquid at the upstream side, since the distance of passing through the liquid discharge head 2 is long. Accordingly, temperature difference occurs among liquid supplied to mutually adjacent discharge modules 3.

The amount of liquid flowing through the common supply channel 4 increases in the present embodiment due to the pump 11, so the increase in temperature of the liquid within the common supply channel 4 can be reduced. Accordingly, the temperature difference of liquid supplied to mutually adjacent discharge modules 3 can be suppressed, and deterioration in image quality can be suppressed.

Third Embodiment

Figure 5:
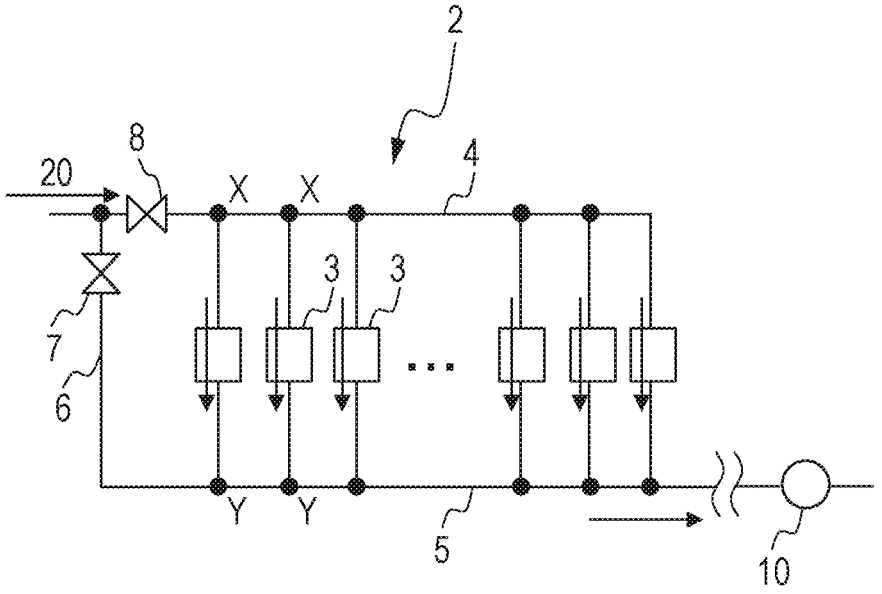
FIG. 5 is a channel diagram illustrating the channel configuration of the liquid discharge apparatus according to a third embodiment of the present invention.

FIG. 5 is a channel diagram schematically illustrating the configuration of channels of the liquid discharge head 2 through which liquid flows, according to a third embodiment of the present invention. FIG. 5 shows the liquid discharge head 2 in the first state where liquid is flowing but discharge is not being performed.

The liquid discharge head 2 according to the present embodiment as illustrated in FIG. 5 has, in addition to the configuration of the first embodiment illustrated in FIGS. 2A and 2B, a valve 8, which is a second valve, provided on the upstream side from all X portions of the common supply channel 4 where the discharge modules 3 are connected. The valve 8 opens under a second opening pressure that is lower than the first opening pressure, which is the opening pressure of the valve 7.

In recording operations where images are recording, the recording duty (the ratio of regions actually recorded as to recording region) varies depending on the content of the image being recorded, so the amount of liquid that is discharges varies, and consequently, the flow rate of the liquid supplied to the discharge modules 3 varies. When the flow rate of the liquid supplied to the discharge modules 3 varies, the pressure within the discharge module 3 fluctuates, and this pressure fluctuation may lead to deterioration in image quality.

The valve 8 in the present embodiment opens at the second opening pressure that is lower than the first opening pressure, which is the opening pressure of the valve 7, so when the pump 10 runs, the valve 8 opens before the valve 7. Accordingly, the liquid flows as the circulatory flow 20 in the order of the common supply channel 4, discharge modules 3, and common recovery channel 5. The pressure of the common supply channel 4 is regulated by the opening pressure of the valve 8 (second opening pressure) at this time, so fluctuation in the pressure in the discharge modules 3 corresponding to the flow rate of liquid can be suppressed. Accordingly, deterioration of image quality due to pressure fluctuation at the discharge modules 3 can be suppressed.

Fourth Embodiment

Figure 6:
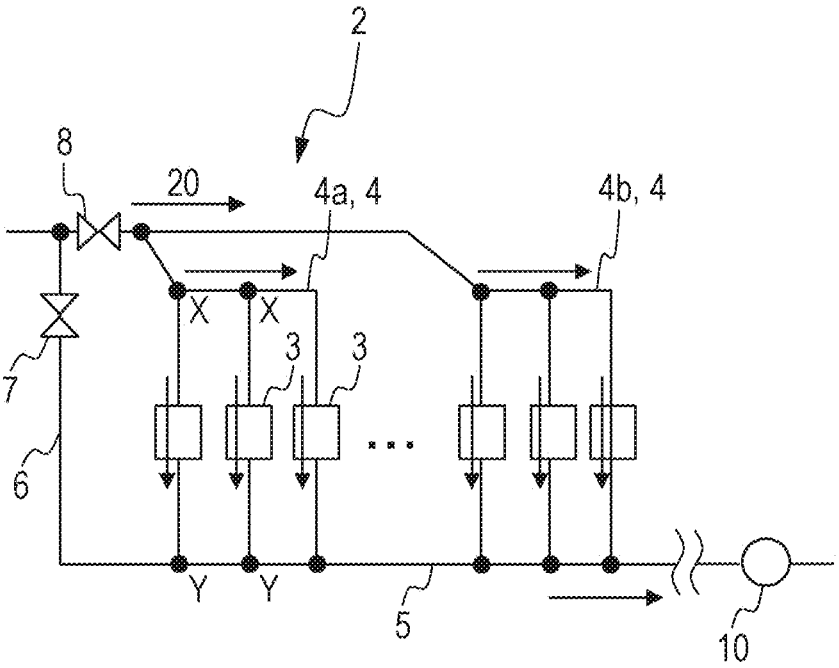
FIG. 6 is a channel diagram illustrating the channel configuration of the liquid discharge apparatus according to a fourth embodiment of the present invention.

FIG. 6 is a channel diagram schematically illustrating the configuration of channels of the liquid discharge head 2 through which liquid flows, according to a fourth embodiment of the present invention. FIG. 6 shows the liquid discharge head 2 in the first state where liquid is flowing but discharge is not being performed.

The liquid discharge head 2 according to the present embodiment as illustrated in FIG. 6 differs from the configuration of the third embodiment illustrated in FIG. 5 with regard to the point that the common supply channel 4 is divided into multiple channels downstream from the valve 8. In the example in FIG. 6, the common supply channel 4 is illustrated as being divided into two channels 4*a* and 4*b*, but may be divided into three or more channels.

At least two discharge modules 3 are connected to each of the channels 4*a* and 4*b*. That is to say, the liquid discharge head 2 has multiple discharge module groups (discharge portion groups) that include multiple discharge modules 3, with a channel connected to each of the discharge module groups. In other words, the liquid discharge head 2 has multiple pressure chamber groups each including multiple pressure chambers 23, with a channel connected to each of the pressure chamber groups. The channel 4*a* is disposed so as to carry liquid from one end portion of the liquid discharge head 2 toward the middle, and the channel 4*b* so as to carry liquid from the middle portion of the liquid discharge head 2 toward the other end portion.

According to the present embodiment, the common supply channel 4 is divided into the channels 4*a* and 4*b*, so the flow rate of liquid flowing through each of the channels 4*a* and 4*b* can be reduced, and consequently the pressure loss occurring at the common supply channel 4 can be reduced. Accordingly, the backpressure of the discharge units can be kept within the appropriate range, so defective discharge can be further suppressed.

Fifth Embodiment

Figure 7:
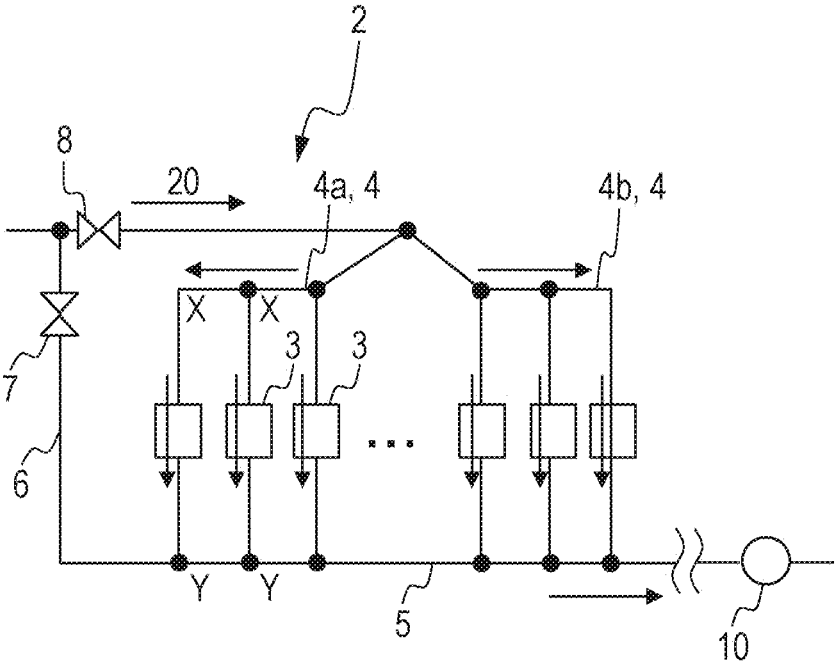
FIG. 7 is a channel diagram illustrating the channel configuration of the liquid discharge apparatus according to a fifth embodiment of the present invention.

FIG. 7 is a channel diagram schematically illustrating the configuration of channels of the liquid discharge head 2 through which liquid flows, according to a fifth embodiment of the present invention. FIG. 7 shows the liquid discharge head 2 in the first state where liquid is flowing but discharge is not being performed.

The liquid discharge head 2 according to the present embodiment as illustrated in FIG. 7 differs from the configuration of the fourth embodiment illustrated in FIG. 6 with regard to the layout of the two channels 4*a* and 4*b*. Specifically, the common supply channel 4 is divided into channels 4*a* and 4*b* at the middle portion of the liquid discharge head 2, and the channels 4*a* and 4*b* each extend toward different end portions from the middle portion of the liquid discharge head 2. Accordingly, the liquid flowing through each of the channels 4*a* and 4*b* head toward the end portions from the middle portion of the liquid discharge head 2.

When the amount of liquid being discharged increases, the temperature of the liquid discharge head 2 rises due to the effects of energy generated to discharge the liquid, as described earlier. At this time, the temperature at the end portions of the liquid discharge head 2 usually is higher than the temperature at the middle portion.

In the present embodiment, the temperature of liquid flowing from the middle portion of the liquid discharge head 2 toward the end portions is low at the discharge modules 3 that are adjacent to each other at the middle, and increases toward the end portions. Accordingly, temperature difference of liquid supplied to adjacent discharge module 3 can be suppressed by the present embodiment in addition to the advantages of the fourth embodiment, and deterioration in image quality can be suppressed.

Figure 8:
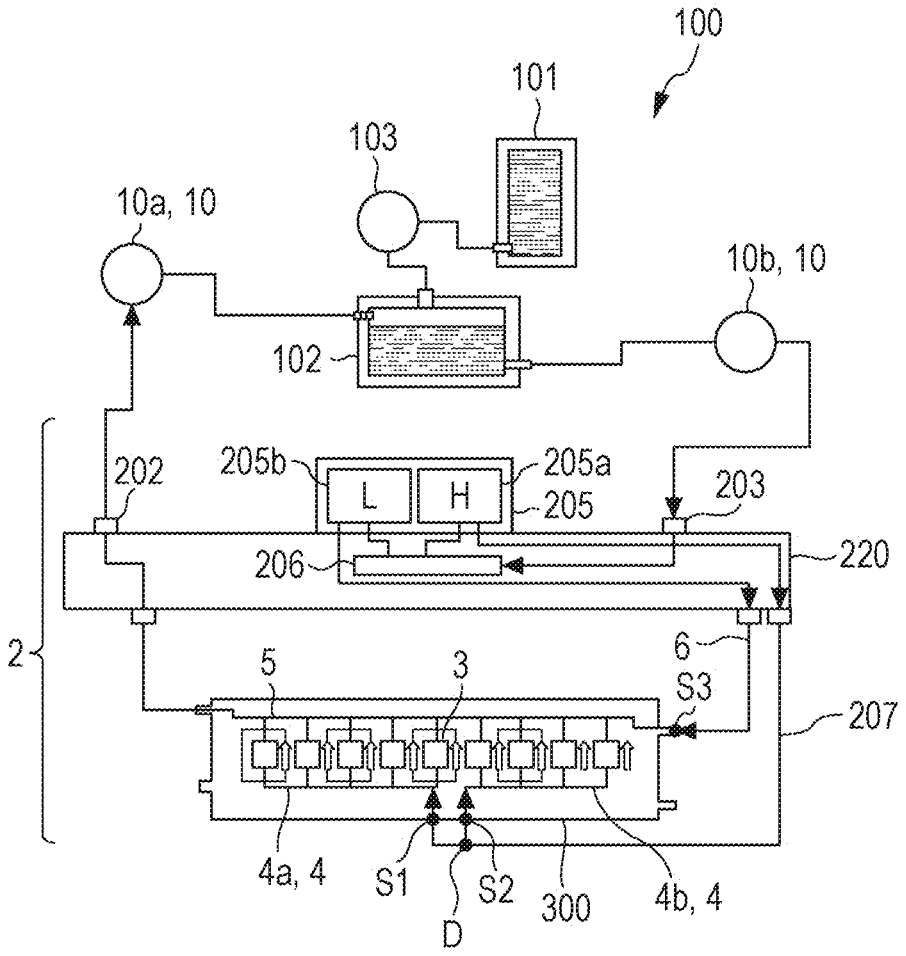
FIG. 8 is a channel diagram illustrating the channel configuration of the liquid discharge apparatus according to an exemplary embodiment of the present invention.

A liquid discharge apparatus 100 having the liquid discharge head 2 according to the fifth embodiment illustrated in FIG. 7 will be described as an exemplary embodiment. FIG. 8 is a diagram illustrating the channel configuration of the liquid discharge apparatus 100 according to the present embodiment. Although the liquid discharge apparatus 100 is capable of discharging liquid of multiple types, only the channels corresponding to one type of liquid is illustrated in FIG. 8.

The liquid discharge apparatus 100 illustrated in FIG. 8 includes the liquid discharge head 2, a main tank 101 that stores liquid, and a buffer tank 102 serving as a sub-tank that temporarily stores liquid to be supplied to the liquid discharge head 2. The liquid discharge apparatus 100 has, as the pump 10 illustrated in FIG. 7, a first circulatory pump 10*a* and a second circulatory pump 10*b* that circulate liquid between the liquid discharge head 2 and buffer tank 102.

The main tank 101 and buffer tank 102 are connected to each other via a replenishing pump 103. When liquid is consumed due to discharge being performed by the liquid discharge head 2 or the like, the replenishing pump 103 transports liquid of the amount that has been consumed from the main tank 101 to the buffer tank 102.

The liquid discharge head 2 includes a liquid discharge unit 300, liquid connecting portions 202 and 203 that are externally connectable, and a liquid supply unit 220 that supplies liquid to and recovers liquid from the liquid discharge unit 300.

The liquid discharge unit 300 has the discharge modules 3, common supply channel 4, and common recovery channel 5, illustrated in FIG. 7. The downstream side of the common recovery channel 5 is connected to the liquid connecting portion 202 via the liquid supply unit 220, and the upstream side of the common supply channel 4 is connected to the liquid connecting portion 203 via the liquid supply unit 220. The liquid connecting portion 202 are connected to the buffer tank 102 via the first circulatory pump 10*a*, and the liquid connecting portion 203 is connected to the buffer tank 102 via the second circulatory pump 10*b*.

The first circulatory pump 10*a* preferably is a positive displacement pump that has quantitative liquid feeding capabilities. Specific examples of the first circulatory pump 10*a* include tube pumps, gear pumps, diaphragm pumps, syringe pumps, and so forth, but these are not restrictive. For example, an arrangement may be made where a constant flow is ensured by disposing a common-use constant-flow value and relief valve at the outlet of the first circulatory pump 10*a*. It is sufficient that the second circulatory pump 10*b* have a certain lift pressure or greater, within the range of flow rate of liquid used when driving the liquid discharge head 2, and turbo pumps, positive-displacement pumps, and the like can be used. Specifically, a diaphragm pump or the like can be used as the second circulatory pump 10*b*.

The first circulatory pump 10*a* and second circulatory pump 10*b* operate to supply liquid within the buffer tank 102 to the liquid discharge head 2 from the liquid connecting portion 203, and further to recover liquid from the liquid connecting portion 202 and return it to the buffer tank 102. Accordingly, a constant amount of liquid flows in the order of the common supply channel 4, discharge modules 3, and common recovery channel 5.

The flow rate of the liquid is preferably set to a certain level or higher, so that the temperature difference among the discharge modules 3 of the liquid discharge head 2 does not affect the image quality. However, if the flow rate is set too high, the difference in negative pressure among the discharge modules 3 may become too high due to the effect of pressure loss in the channels within the liquid discharge unit 300, and unevenness may occur in the images. Accordingly, the flow rate of the liquid is preferably set as appropriate, taking into consideration the temperature difference and negative pressure difference among the discharge modules 3.

The liquid supply unit 220 has a negative pressure control unit 205 that controls pressure using negative pressure, and a filter 206 that removes foreign matter in the liquid, provided on the channel connecting the liquid connecting portion 202 and liquid discharge unit 300. The negative pressure control unit 205 has a valve function of operating to maintain pressure at the downstream side of the negative pressure control unit 205 at a control pressure set beforehand, even in a case where the flow rate of liquid circulating through the circulatory channels changes due to varying recording duty.

Specifically, the negative pressure control unit 205 has two pressure adjustment mechanisms 205*a* and 205*b*, set to different control pressures from each other. The control pressure of the first pressure adjustment mechanism 205*a* is higher than the control pressure of the second pressure adjustment mechanism 205*b*. The input end of the pressure adjustment mechanism 205*a* is connected to the liquid connecting portion 203 via the filter 206, and the output end of the pressure adjustment mechanism 205*a* is connected to the common supply channel 4. The input end of the pressure adjustment mechanism 205*b* is connected to the liquid connecting portion 203 via the filter 206, and the output end of the pressure adjustment mechanism 205*b* is connected to the common recovery channel 5.

According to the configuration described above, the pressure adjustment mechanism 205*a* functions as the valve 8 illustrated in FIG. 7, and the pressure adjustment mechanism 205*b* functions as the valve 7. The channel connecting the output end of the pressure adjustment mechanism 205*b* and the common recovery channel 5 is the adjustment channel 6. The control pressure of the pressure adjustment mechanism 205*a* corresponds to the second opening pressure, and the control pressure of the pressure adjustment mechanism 205*b* corresponds to the first opening pressure.

Note that the pressure adjustment mechanisms 205*a* and 205*b* are not restricted in particular as long as capable of controlling pressure downstream thereof to fluctuation within a certain range centered on the control pressure. For example, a mechanism equivalent to a so-called "pressure-reducing regulator" can be employed as a pressure adjustment mechanism. In a case of using a mechanism equivalent to a "pressure-reducing regulator", the upstream side of the negative pressure control unit 205 is preferably pressurized by the second circulatory pump 10*b* via the liquid supply unit 220. This enables the effects of water head pressure of the buffer tank 102 as to the liquid discharge head 2 to be suppressed, giving broader freedom in the layout of the buffer tank 102 in the liquid discharge apparatus 100. Note that a water head tank disposed with a certain water head difference as to the negative pressure control unit 205*b*, for example, may be used instead of the second circulatory pump 10*b*.

There is a total of three supply points where liquid is supplied to the liquid discharge unit 300; two at the middle portion of the liquid discharge unit 300, and one at the end of the liquid discharge unit 300. The two supply points S1 and S2 at the middle portion are respectively connected to the common supply channels 4 divided into two. The supply point S3 at the end is connected to the common recovery channel 5. A channel 207 that connects the output end of the pressure adjustment mechanism 205*a* and the common supply channel 4 is branched at a branch point D, and connected to the respective supply points S1 and S2. The adjustment channel 6 is connected to the supply point S3.

The control pressure of the pressure adjustment mechanism 205*a* connected to the common supply channel 4 is higher than the control pressure of the pressure adjustment mechanism 205*b* connected to the common recovery channel 5 as described earlier, with the first circulatory pump 10*a* being connected to the common recovery channel 5 alone. Accordingly, when the first circulatory pump 10*a* runs, flows of liquid are generated from the common supply channel 4 toward the common recovery channel 5 through the discharge modules 3, as indicated by the outline arrows in FIG. 8.

If the amount of liquid discharged from the liquid discharge head 2 increases in this state, the pressure in the common supply channel 4 drops due to pressure loss generated when the liquid flows through the common supply channel 4, discharge modules 3, and common recovery channel 5. When the pressure falls to below the control pressure of the pressure adjustment mechanism 205*b*, a flow of liquid is generated that does not pass through the discharge modules 3. Accordingly, the increase in pressure as to the flow rate becomes gentle in the present embodiment as well, so even in a case of performing discharge at even higher speeds, defective discharge can be suppressed.

Figure 9:
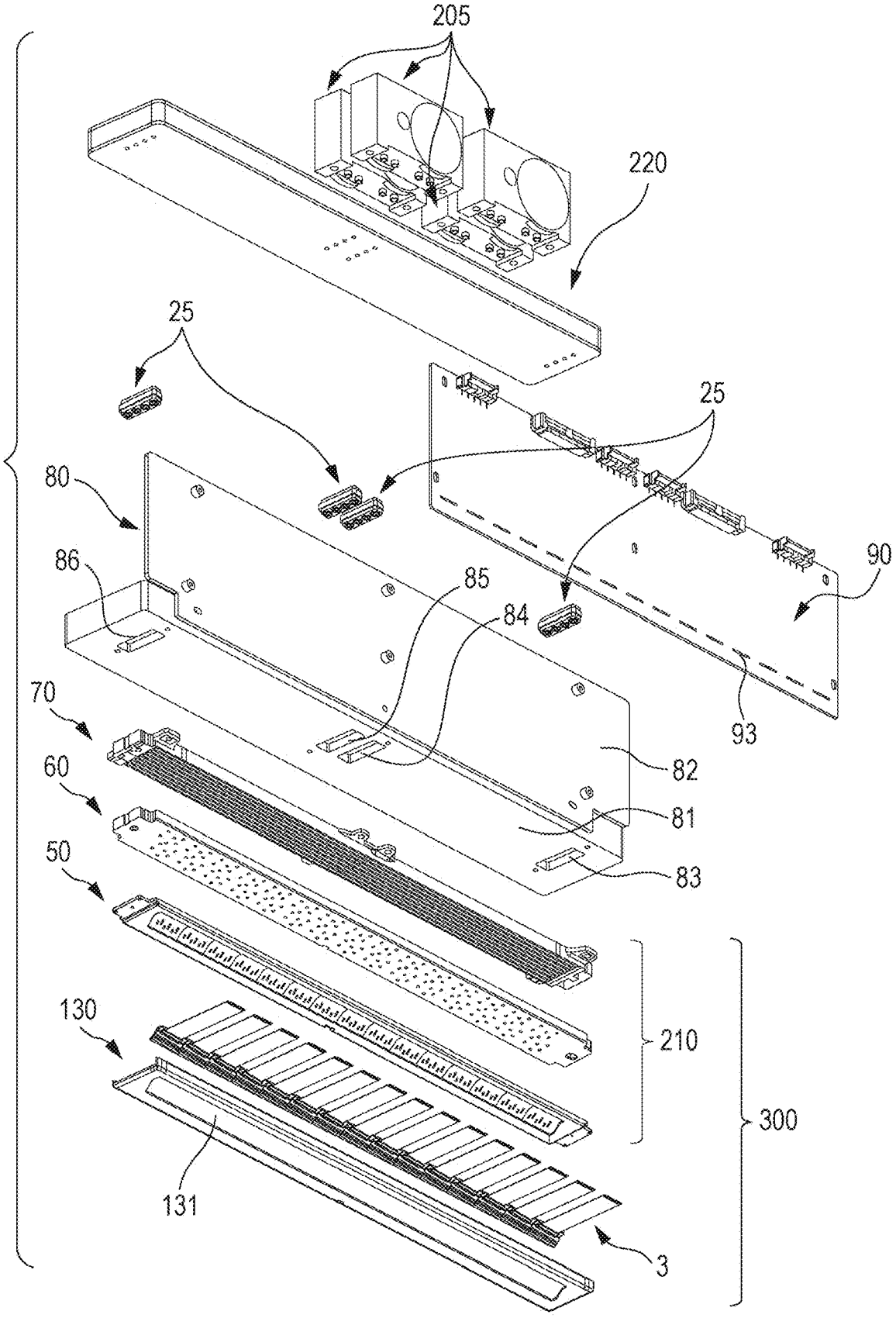
FIG. 9 is a disassembled perspective view illustrating parts and units making up a liquid discharge head.

Next, an example of the liquid discharge head 2 will be described in further detail. FIG. 9 is a disassembled perspective view illustrating the parts and units making up the liquid discharge head 2. The liquid discharge head 2 has the liquid discharge unit 300, liquid supply unit 220, and an electric wiring board 90 attached to a case 80. The liquid connecting portions (see 202 and 203 in FIG. 8) are provided to the liquid supply unit 220. Filters for each color (see 206 in FIG. 8) are provided communicating with each opening of the liquid connecting portions, in order to remove foreign material in liquid that is supplied thereto. There are provided two liquid supply units 220, and each has filters for two colors. The liquids that have passed the filters are supplied to the negative pressure control units 205 disposed upon the liquid supply unit 220 in accordance with the respective colors. The negative pressure control units 205 are units made of pressure adjustment valves for the respective colors. The negative pressure control units 205 markedly reduce pressure drop fluctuation within the supply system of the liquid discharge apparatus 100 (supply system at the upstream side of the liquid discharge head 2) that occurs due to change in the flow rate of liquid, by the workings of the valves, spring members, and so forth, provided therein. Accordingly, the change in negative pressure downstream from the pressure control unit (toward the liquid discharge unit 300 side) can be stabilized within a certain range. Two pressure adjustment valves are built in for each color, each being set to a different control pressure. The high-pressure side valve of the two pressure adjustment valves is connected to a common supply channel 211 within the liquid discharge unit 300, and the low-pressure side to a common recovery channel 212, via the liquid supply unit 220.

The case 80 is configured including a liquid discharge unit support member 81 and electric wiring board support member 82, and supports the liquid discharge unit 300 and electric wiring board 90 as well as securing rigidity of the liquid discharge head 2. The electric wiring board support member 82 is for supporting the electric wiring board 90, and is fixed by being screwed to the liquid discharge unit support member 81. The liquid discharge unit support member 81 serves to correct warping and deformation of the liquid discharge unit 300, and thus secure relative positional accuracy of the multiple discharge modules 3 (more precisely, the recording element boards 111 illustrated in FIG. 10), thereby suppressing unevenness in the recorded article. Accordingly, the liquid discharge unit support member 81 preferably has sufficient rigidity. Examples of suitable materials includes metal materials such as stainless steel and aluminum, and ceramics such as alumina. The liquid discharge unit support member 81 has openings 83 through 86 into which joint rubber members 25 are inserted. Liquid supplied from the liquid supply unit 220 passes through a joint rubber member and is guided to a third channel member 70 which is a part making up the liquid discharge unit 300.

The liquid discharge unit 300 is made up of multiple discharge modules 3 and a channel member 210, and a cover member 130 is attached to the face of the liquid discharge unit 300 that faces the recording medium. The cover member 130 is a member having a frame-shaped face where a long opening 131 is provided. The recording element boards 111 included in the discharge module 3 and a sealant are exposed from the opening 131. The frame portion on the perimeter of the opening 131 functions as a contact surface for a cap member that caps off the liquid discharge head 2 when in standby. Accordingly, a closed space is preferably formed when capping, by coating the perimeter of the opening 131 with an adhesive agent, sealant, filling member, or the like, to fill in roughness and gaps on the discharge orifice face of the liquid discharge unit 300.

Next, description will be made regarding the configuration of the channel member 210 included in the liquid discharge unit 300. The channel member 210 is an article formed by laminating a first channel member 50, a second channel member 60, and the third channel member 70. The channel member 210 has a channel that supplies liquid to the discharge modules 3 (recording element boards 111) and a channel to recover liquid from the discharge modules 3, while supporting the discharge modules 3 (recording element boards 111). The channel member 210 is a channel member that distributes the liquid supplied from the liquid supply unit 220 to each of the discharge modules 3, and returns liquid recirculating from the discharge modules 3 to the liquid supply unit 220. The channel member 210 is fixed to the liquid discharge unit support member 81 by screws, thereby suppressing warping and deformation of the channel member 210. The multiple discharge modules 3 are provided on the first channel member 50 in a straight line, and as a result, multiple recording element boards 111 are arrayed in a straight line.

The first through third channel members 50 through 70 preferably are corrosion-resistant as to the liquid, and formed from a material having a low linear expansion coefficient. Examples suitable materials include composite materials (resin materials) where inorganic filler such as fine particles of silica or fiber or the like has been added to a base material. Examples of the base material include alumina, liquid crystal polymer (LCP), polyphenyl sulfide (PPS), polysulfone (PSF), and denatured polyphenylene ether (PPE). The channel member 210 may be formed by laminating the three channel members and adhering, or in a case of selecting a composite resin material for the material, the three channel members may be joined by fusing.

The multiple liquid connecting portions that connect the liquid discharge head 2 to the outside by fluid connection are disposed together at one end side of the liquid discharge head 2 in the longitudinal direction. Multiple negative pressure units 230 are disposed together at the other end side of the liquid discharge head 2.

Figure 10A:
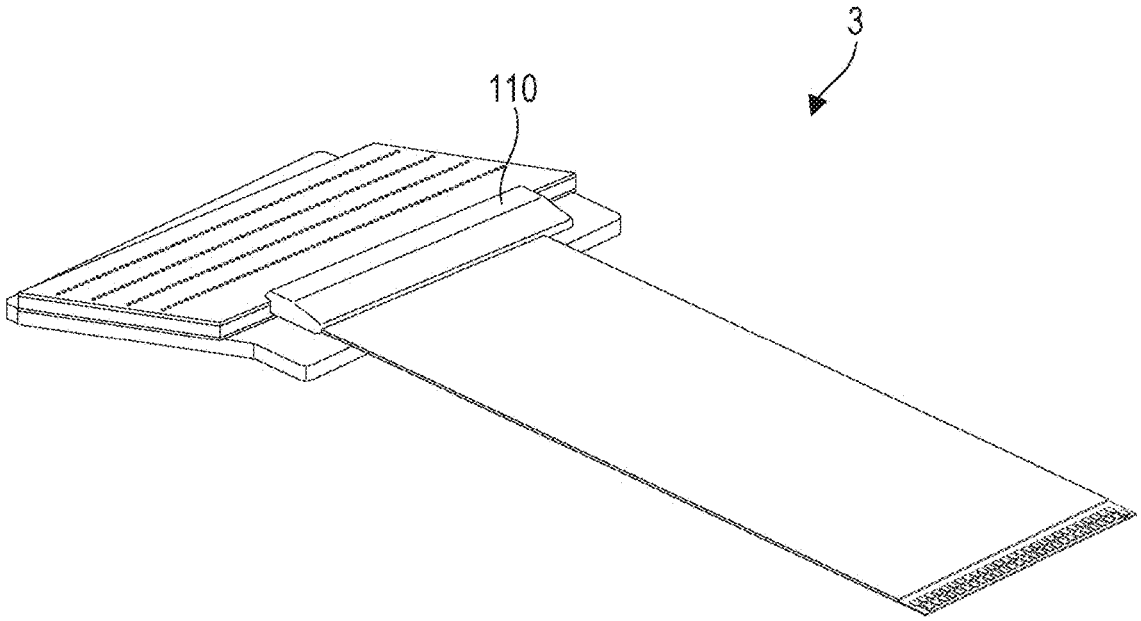
FIGS. 10A and 10B are diagrams illustrating example of discharge modules.
Figure 10B:
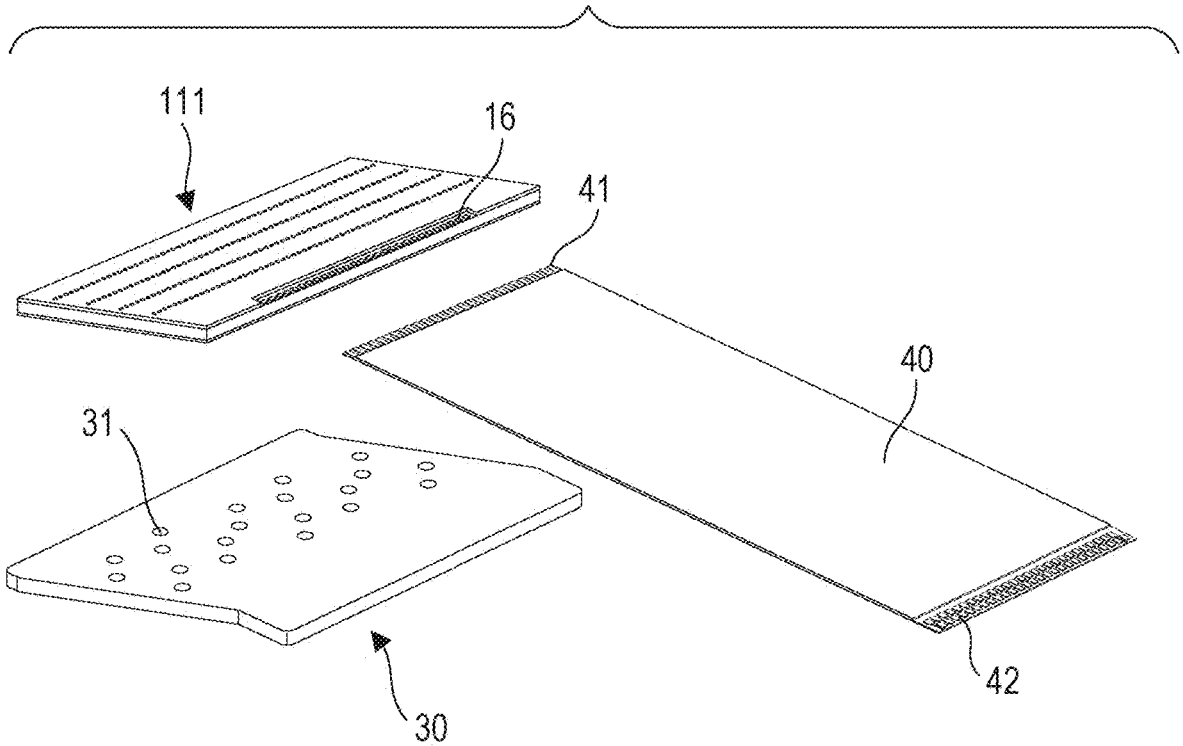

FIGS. 10A and 10B illustrate an example of a discharge module 3. Specifically, FIG. 10A is a perspective view of a discharge module 3, and FIG. 10B is a disassembled view of the discharge module 3. The method of manufacturing the discharge module 3 is as follows. First, a recording element board 111 and flexible printed circuit board 40 are adhered upon a support member 30 in which liquid communication ports 31 have been formed beforehand. Subsequently, terminals 16 on the recording element board 111 are electrically connected to terminals 41 on the flexible printed circuit board 40 by wire bonding, following which the wire-bonded portion (electric connection portion) is covered and sealed by a sealant 110. Terminals 42 at the other end of the flexible printed circuit board 40 from the terminals 41 connected to the recording element board 111 are electrically connected to connection terminals 93 (see FIG. 9) of the electric wiring board 90. The support member 30 is a support member that supports the recording element board 111, and also is a channel member communicating between the recording element board 111 and the channel member 210 by fluid connection. Accordingly, the support member 30 should have a high degree of flatness, and also should be able to be joined to the recording element board 111 with a high degree of reliability. Examples of suitable materials for the support member 30 include alumina and resin materials. The discharge module 3 is not restricted to the above-described configuration, and various forms may be applied. It is sufficient for the discharge module 3 to have at least an energy-generating element 24 that generates energy used for discharging liquid, a pressure chamber having the energy-generating element 24 within, and a discharge orifice 13 that discharges the liquid.

Figure 11:
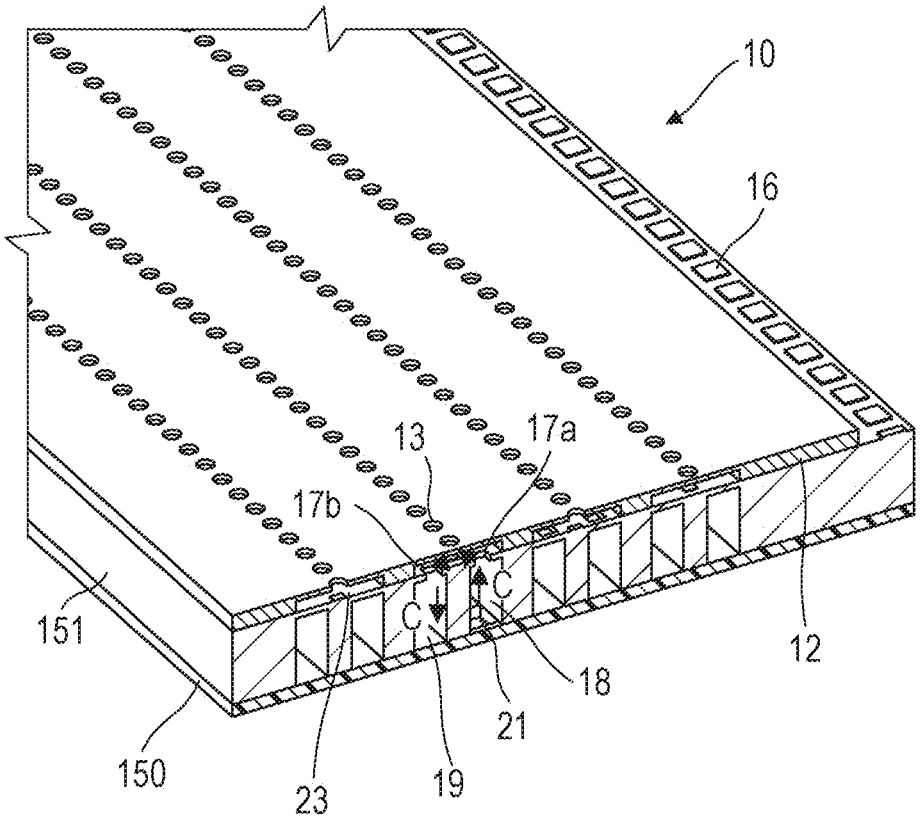
FIG. 11 is a perspective view illustrating a cross-section of a recording element board and cover plate.

FIG. 11 is a perspective view illustrating a cross-section of the recording element board 111 and a cover plate 150. The flow of liquid inside the recording element board 111 will be described with reference to FIG. 11.

The cover plate 150 functions as a lid making up part of the walls of liquid supply channels 18 and liquid recovery channels 19 formed on a substrate 151 of the recording element board 111. The recording element board 111 is formed by laminating the substrate 151 formed of silicon (Si) and a discharge orifice forming member 12 formed of a photosensitive resin, with the cover plate 150 joined on the rear face of the substrate 151. Recording elements 15 are formed on one face side of the substrate 151, with the grooves making up the liquid supply channels 18 and liquid recovery channels 19 extending along the discharge orifice rows being formed at the reverse side thereof. The liquid supply channels 18 and liquid recovery channels 19 formed by the substrate 151 and cover plane 150 are respectively connected to the common supply channels 211 and common recovery channels 212 within the channel member 210, and there is differential pressure between the liquid supply channels 18 and liquid recovery channels 19. When liquid is being discharged and recording is being performed, the liquid flows as follows due to differential pressure at the discharge orifices 13 that are not performing discharge operations. That is to say, the liquid within the liquid supply channel 18 provided within the substrate 151 flows to the liquid recovery channel 19 via a supply port 17*a*, pressure chamber 23, and recovery port 17*b* (arrow C in FIG. 12). This flow enables liquid that has thickened due to evaporation from the discharge orifices 13, bubbles, foreign matter, and so forth, to be recovered to the liquid recovery channel 19 from the discharge orifices 13 and pressure chambers 23 where recording is not being performed. This also enables thickening of liquid and increased concentration of color material at the discharge orifices 13 and pressure chambers 23 to be suppressed. Liquid recovered to the liquid recovery channels 19 is recovered in the order of communication ports 51 in the channel member 210, individual recovery channels 214, and the common recovery channel 212, via the openings 21 of the cover plate 150 and the liquid communication ports 31 of the support member 30 (see FIG. 10), and thereafter is recovered to the supply path of the liquid discharge apparatus 100. That is to say, the liquid supplied to the liquid discharge head 2 from the main body of the liquid discharge apparatus flows in the order described below, and thus is supplied and recovered.

First, the liquid flows from the liquid connection portions of the liquid supply unit 220 into the liquid discharge head 2. The liquid then is supplied to the joint rubber members 25, communication ports 72 and common channel grooves 71 provided to the third channel member, common channel grooves 62 and communication ports 61 provided to the second channel member, and individual channel grooves 52 and communication ports 51 provided to the first channel member. Thereafter, the liquid is supplied to the pressure chambers 23 in the order of the liquid supply channels 18 and supply ports 17*a* provided to the substrate 151. The liquid that has been supplied to the pressure chambers 23 but not discharged from the discharge orifices 13 flows in the order of the recovery ports 17*b* and liquid recovery channels 19 provided to the substrate 151, the openings 21 provided to the cover plate 150, and the liquid communication ports 31 provided to the support member 30. Thereafter, the liquid flows in the order of the communication ports 51 and individual channel grooves 52 provided to the first channel member 50, the communication ports 61 and common channel grooves 62 provided to the second channel member 60, the common channel grooves 71 and communication ports 72 provided to the third channel member 70, and the joint rubber members 25. The liquid further flows outside of the liquid discharge head 2 from the liquid connection portions provided to the liquid supply unit 220. Thus, in the liquid discharge head according to the present embodiment, liquid within a pressure chamber 23, which has an energy-generating element 24 within that is used for discharging liquid, can be circulated between inside and outside of the pressure chamber 23.

The configurations illustrated in the above-described embodiments are only exemplary, and the present invention is not restricted to these configurations. For example, the liquid discharge apparatus 100 is not restricted to being an ink jet recording apparatus, and may be anything that discharges liquid.

According to the present invention, a first valve that is opened under a first opening pressure is provided in an adjustment channel connecting a supply channel and a recovery channel, and the channel resistance of the adjustment channel is smaller than the channel resistance of a discharge portion. Accordingly, when discharge of liquid is performed by the discharge portion and the flow rate of liquid supplied to the discharge portion increases, the pressure at the recover channel falls, and the first valve can be opened. In this case, part of the liquid supplied to the discharge portion is allocated to the adjustment channel where channel resistance is lower than that at the discharge portion. Accordingly, the flow rate of liquid flowing through the discharge portion where the channel resistance is high can be reduced, so the increase on pressure loss can be made gentle even in a case where further high-speed discharge is performed. Accordingly, the backpressure of the discharge portion can be kept within an appropriate range even in a case where further high-speed discharge is performed, so defective discharge can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-015515, filed Jan. 31, 2017, which is hereby incorporated by reference herein in its entirety.

What is claimed is:

1. A liquid discharge apparatus, comprising:

a plurality of discharge portions that include a discharge orifice configured to discharge liquid, an energy-generating element configured to generate energy used to discharge liquid from the discharge orifice, and a pressure chamber having the energy-generating element within;

a common supply channel for liquid, connected to one end side of the plurality of discharge portions;

a common recovery channel for liquid, connected to the other end side of the plurality of discharge portions;

an adjustment channel connecting the common supply channel and the common recovery channel;

a first valve that is provided in the adjustment channel and is opened under a first opening pressure; and a first fluid arrangement configured to cause the liquid to flow from the common supply channel toward the common recovery channel, wherein channel resistance of the adjustment channel is smaller than channel resistance of the discharge portion.

2. The liquid discharge apparatus according to claim 1, wherein the adjustment channel connects a side of the common supply channel that is further upstream than portions connecting to the plurality of discharge portions, and a side of the common recovery channel that is further upstream than portions connecting to the plurality of discharge portions.

3. The liquid discharge apparatus according to claim 1, further comprising:

a second fluid arrangement, which is provided to the common supply channel at a side further downstream than portions connecting to the plurality of discharge portions, and is configured to cause the liquid to flow through the common supply channel.

4. The liquid discharge apparatus according to claim 1, further comprising:

a second valve, which is provided to the provided to the common supply channel at a side further upstream than portions connecting to the plurality of discharge portions, and is opened under a second opening pressure that is smaller than the first opening pressure.

5. The liquid discharge apparatus according to claim 1, further comprising:

a plurality of discharge portion groups including the plurality of discharge portions, wherein the common supply channel is divided into a plurality of channels respectively connected to the plurality of discharge portion groups.

6. The liquid discharge apparatus according to claim 5, further comprising:

a liquid discharge head having the discharge portions and the common supply channel, wherein the plurality of channels each extend from a middle portion of the liquid discharge head toward an end thereof.

7. A liquid discharge head, comprising:

a plurality of pressure chambers, each having within an energy-generating element configured to generate energy used to discharge liquid from a discharge orifice;

a common supply channel configured to supply liquid to the pressure chambers, connected to one end side of the plurality of pressure chambers;

a common recovery channel configured to recover liquid from the pressure chambers, connected to the other end side of the plurality of pressure chambers;

an adjustment channel connecting the common supply channel and the common recovery channel; and a valve that is provided in the adjustment channel and is opened under a predetermined opening pressure, wherein channel resistance of the adjustment channel is smaller than channel resistance of channels including the pressure chambers and connecting the common supply channel and the common recovery channel.

8. The liquid discharge head according to claim 7, wherein the adjustment channel connects a side of the common supply channel that is further upstream than portions connecting to the plurality of pressure chambers, and a side of the common recovery channel that is further upstream than portions connecting to the plurality of pressure chambers.

9. The liquid discharge head according to claim 7, further comprising:

second valve, which is provided to the provided to the common supply channel at a side further upstream than portions connecting to the plurality of discharge portions, and is opened under a pressure that is smaller than the predetermined pressure.

10. The liquid discharge head according to claim 7, further comprising:

a plurality of pressure chamber groups including the plurality of pressure chambers, wherein the common supply channel is divided into a plurality of channels respectively connected to the plurality of pressure chamber groups.

11. The liquid discharge head according to claim 10, wherein the plurality of channels each extend from a middle portion of the liquid discharge head toward an end thereof.

12. The liquid discharge head according to claim 7, further comprising:

a plurality of recording element boards having the energy-generating elements and the pressure chambers, wherein the plurality of recording element boards are arrayed in a straight line.

13. The liquid discharge head according to claim 12, further comprising:

a channel member having the common supply channel and the common recovery channel, wherein the channel member supports the plurality of recording element boards.

14. The liquid discharge head according to claim 7, further comprising:

a first pressure adjustment mechanism connected to the common supply channel; and a second pressure adjustment mechanism connected to the common recovery channel, wherein control pressure of the first pressure adjustment mechanism is higher than control pressure of the second pressure adjustment mechanism.

15. The liquid discharge head according to claim 7, wherein the liquid discharge head is a pagewide liquid discharge head having a length corresponding to a width of a recording medium on which recording is performed.

16. The liquid discharge head according to claim 7, wherein liquid in the pressure chambers is circulated between inside of the pressure chambers and outside of the pressure chambers.

17. A liquid discharge apparatus, comprising:

a plurality of pressure chambers, each having within an energy-generating element configured to generate energy used to discharge liquid from a discharge orifice;

a common supply channel for liquid, connected to one end side of the plurality of pressure chambers;

a common recovery channel for liquid, connected to the other end side of the plurality of pressure chambers;

an adjustment channel connecting the common supply channel and the common recovery channel;

a valve that is provided in the adjustment channel and is opened under a predetermined opening pressure; and a fluid arrangement configured to cause the liquid to flow from the common supply channel toward the common recovery channel, wherein the liquid discharge apparatus operates in a first flow mode, where liquid is caused to flow from the common supply channel to the common recovery channel via the pressure chambers, without liquid being discharged from the discharge orifice, and a second flow mode, where liquid is caused to flow from the common supply channel to the common recovery channel via the pressure chambers, while liquid is discharged from the discharge orifice, and wherein the valve is closed in the first flow mode and is open in the second flow mode.

18. The liquid discharge apparatus according to claim 17, wherein, in the second flow mode, the liquid in the common supply channel is supplied to the common recovery channel via the valve in the adjustment channel.

19. The liquid discharge apparatus according to claim 17, wherein the flow rate of liquid flowing through the pressure chambers in the second flow mode is smaller than the flow rate of liquid flowing through the pressure chambers in the second flow mode.

* * * * *